United States Patent [19]

Gueret

[11] 4,409,967

[45] Oct. 18, 1983

[54] MANUAL MASSAGE INSTRUMENT

[75] Inventor: Jean-Louis H. Guéret, Paris, France

[73] Assignee: L'Oreal, Paris, France

[21] Appl. No.: 194,492

[22] Filed: Oct. 6, 1980

[30] Foreign Application Priority Data

Oct. 23, 1979 [FR] France ..... 79 26255

[51] Int. Cl.[3] ..... A61H 7/00

[52] U.S. Cl. ..... 128/62 R; 128/67

[58] Field of Search ..... 128/62 R, 62 A, 65, 128/67; 15/5, 110, 141 R, 159, 187, 188, 190, 195, 196, 186

[56] References Cited

U.S. PATENT DOCUMENTS

| | | | |
|---|---|---|---|
| 3,691,585 | 9/1972 | Flom | 15/187 |
| 3,867,928 | 2/1975 | Tupper | 128/67 |
| 3,886,619 | 6/1975 | Natman | 15/187 |

FOREIGN PATENT DOCUMENTS

| | | | |
|---|---|---|---|
| 922011 | 10/1948 | France | 128/67 |
| 519645 | 3/1953 | France | 128/67 |
| 2019220 | 10/1979 | United Kingdom | 128/67 |

*Primary Examiner*—Richard J. Apley
*Assistant Examiner*—David J. Brown
*Attorney, Agent, or Firm*—N. Jerome Rudy

[57] ABSTRACT

A massage instrument for the skin which comprises at least one active face on which there are provided a plurality of projecting spikes made of a flexible, elastically deformable material, wherein the spikes are constituted by intersecting or non-intersecting plates and are distributed in accordance with the angular orientation of their plates in at least two groups, the spikes of a same group being disposed, on the active face of the instrument, so as to alternate with the spikes of another same group.

10 Claims, 6 Drawing Figures

MANUAL MASSAGE INSTRUMENT

BACKGROUND OF THE INVENTION

1. Field of the Invention

The present invention relates to a manually operated massage instrument designed to cause a localized hyperaemia in the areas of the skin subjected to the massage. This localized hyperaemia consists in a congestion of the blood due to an activation of the underlying circulation, and facilitates the penetration of suitable substances. It is possible, therefore, to profit from this effect in particular in the field of cosmetics, in order to enable penetration of various creams or lotions into the area of the skin which has been congested by massage.

2. Description of the Prior Art

Present massage instruments include the friction glove and the massage brush, the latter having a plurality of spikes or points on its active surface which, on contact with the skin, cause a slight depression in the skin and consequently a localized hyperaemia.

In the French Patent Application No. 78-12063 filed on 24th Apr. 1978 (now published as French Pat. No.: 2,424,022 issued May 24, 1982), there is disclosed a massage brush whose active surface is provided with asymmetrical spikes made of an elastically deformable, flexible material each having a concave portion and an opposite convex portion. The above-mentioned asymmetrical spikes in effect have a greater bending strength when their convex portion is used and a lower strength when their concave portion is used. In addition, the spikes are disposed facing away from one another, i.e. one spike having its concave portion facing in one direction is adjacent to a spike having its concave portion facing in the other direction. The above massage instrument provides a double advantage: in the first instance, the efficiency of the skin massage is improved greatly in comparison with the massage obtained by known massage instruments such as a friction glove. In effect, the friction on the skin caused by spikes having alternating zones whose bending strength in the direction of displacement of the applicator is high and zones whose bending strength in the same direction is lower, causes on the skin the formation of wave-like or sinuous depressions which are displaced on the skin simultaneously with the massage instrument. In addition, as the spikes are made of an elastically deformable, flexible material, a brush of this type allows forceful massage of the skin without the risk of lesions or abrasions of the epidermal layers whilst adapting completely to the various morphologies of users.

SUMMARY OF THE INVENTION

It is an object of the present invention to provide another massage instrument having spikes which are preferably symmetrical and which have alternate less flexible and more flexible portions. According to the invention, the spikes are constituted by intersecting or non-intersecting plates which have, on one hand, a higher bending strength and consequently a "harder" contact on the skin if the faces of the plates constituting the spikes are used and, on the other hand, a lower bending strength and consequently a "softer" contact if one of the sides of the plates of the spikes is used. The spikes all have the same shape but are disposed with at least two different angular orientations, so that in the case of rectilinear massage the region of the skin on which the massage instrument of the invention is dis placed is subjected to the action of alternating hard and soft spikes.

The present invention therefore provides a massage instrument for massaging the skin, on at least one active face of which instrument there are provided a plurality of projecting spikes made of a flexible, elastically deformable material, wherein the spikes are constituted by intersecting or non-intersecting plates and are distributed in accordance with the angular orientation of their plates in at least two groups, the spikes of a same group being disposed, on the active face of the instrument, so as to alternate with the spikes of another same group.

In a preferred construction, the spikes are constructed in one piece with their support from a flexible, rubbery material; the plates constituting the spikes are substantially disposed at right angles on their support and have the shape of the segment of a circle which is connected by its chord to the support; and the surrounding surface of the face of the plates belonging to each spike has substantially the shape of a spherical portion.

In a first embodiment, the spikes each consist of two intersecting plates which have, in plan view, the shape of an X, the angular orientation of the intersecting plates of the spikes belonging to one group relative to the angular orientation of the intersecting plates of the spikes belonging to the other group being determined by rotation about an axis passing through the intersection peak of the two intersecting plates of the spikes; each of the spikes is of a symmetrical shape about an axis passing through the peak of intersection of the two intersecting plates which constitute it; the two intersecting plates of each spike are preferably disposed substantially at right angles and the spikes of a same group are oriented at 45° with respect to the spikes of the other same group; the intersecting plates of the spikes are advantageously cut over a portion of their height at right angles to their intersection peak.

In a second embodiment, the spikes are constituted by non-intersecting plates which are substantially parallel, the plates of the spikes of a same group being orientated angularly with respect to the plates of the spikes of another same group; the spikes are preferably disposed in four groups, the plates of the spikes of a same group being orientated at 45° or a multiple thereof with respect to the plates of the spikes of another same group.

In the present invention, whatever the embodiment thereof, the spikes may be equally well disposed in substantially parallel rows or along wave-like lines, two wave-like lines then being in phase opposition, or in concentric circles.

The massage instrument of the invention may comprise a massage brush, whose flexible support for the spikes is inserted within a rigid frame which may or may not be connected to a handle; the massage instrument may alternatively be a massage glove, i.e. a flexible bag on at least one of the surfaces of which project the spikes defined above. The massage instrument of the invention may be used not only for massage but also for the simultaneous washing of the skin. In this case, as disclosed in the first French Application of Addition No. 78-34330 filed on 6th Dec. 1978, the flexible support which bears the spikes may be provided with perforations and associated with a container designed to contain a hydrosoluble product, for example a bar of soap.

DETAILED DESCRIPTION OF THE DRAWINGS

DESCRIPTION OF THE PREFERRED EMBODIMENTS

Figure 1:
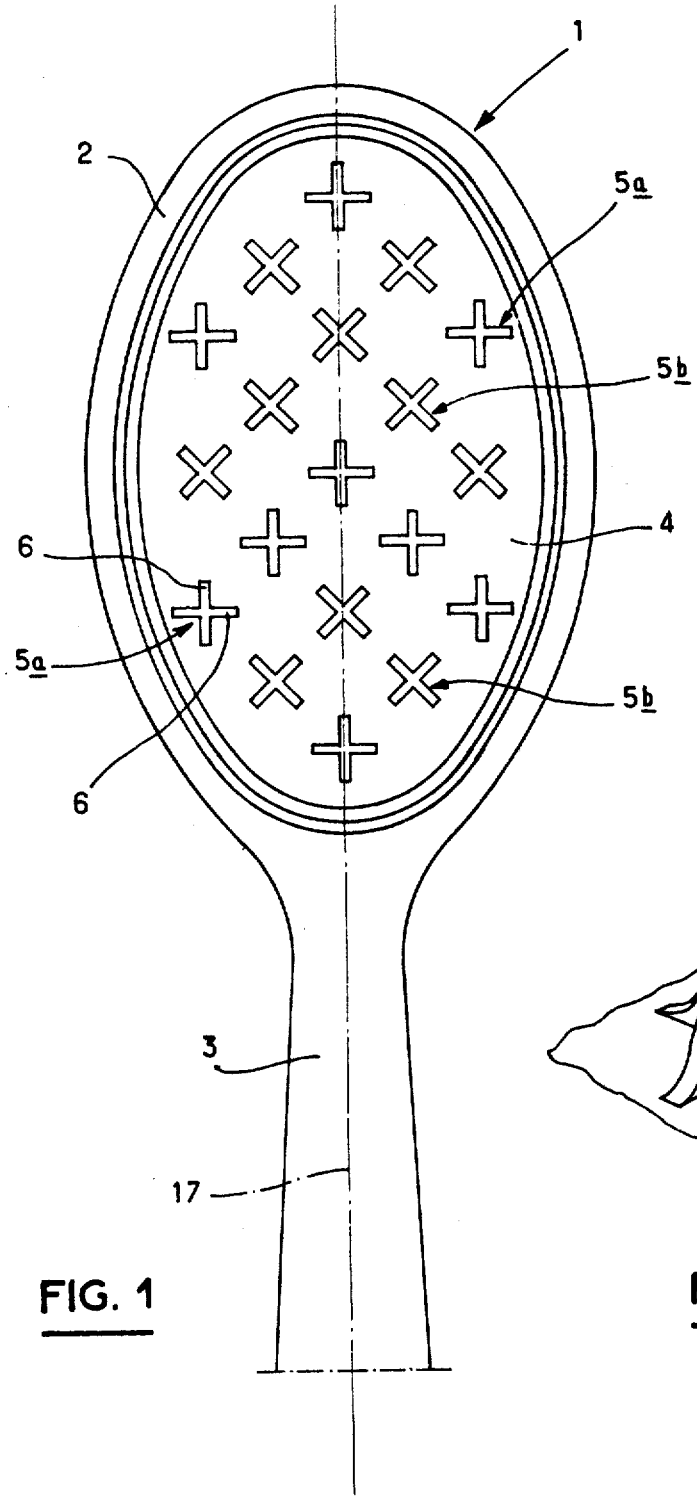
FIG. 1 is a plan view of a massage brush in accordance with a first embodiment of the invention.
Figure 2:
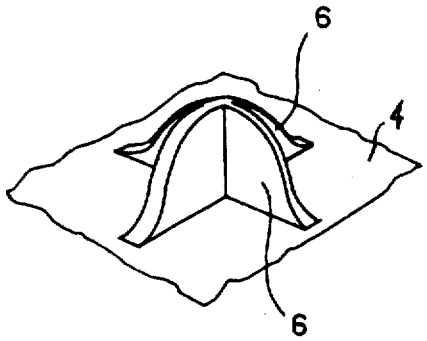
FIG. 2 is a perspective view, on an enlarged scale, of two intersecting plates constituting one of the spikes with which the brush of FIG. 1 is provided.

With reference to FIGS. 1 and 2 of the drawings, a brush 1 designed for skin massage has a frame 2 integral with a handle 3. The frame 2 and the handle 3 may be made of any suitable material, for example wood or molded plastics. One of the faces of the frame 2 is provided with a cavity of elongate shape whose longitudinal section is substantially elliptical; within the cavity there is mounted a flexible support 4 from which project spikes 5*a*, 5*b* for the purposes of skin massage.

In this embodiment, the support 4 and the spikes 5*a*, 5*b* are rigidly molded from a flexible rubbery material; the flexible support consists of a disk with an elliptical cut-out section whose surface is slightly higher than the surface of the cavity made in the frame 2. Consequently, the flexible support 4 has, when positioned on the frame 2, a curved shape whose convex portion is directed towards the exterior of the brush.

The shape of the spikes 5*a* is absolutely identical to that of the spikes 5*b*, and only their relative angular orientation is different. The spikes 5*a*, 5*b* in plan view have the shape of an X, in which two intersecting plates 6 which constitute the X intersect at right angles. The spikes 5*a*, 5*b* have a symmetrical structure with respect to an axis passing through the intersection peak of the two intersecting plates 6. The two intersecting plates 6 of the spikes intersect substantially at right angles on the flexible support 4; they each have substantially the shape of the segment of a circle which is connected by its chord to the flexible support 4. In this embodiment, the maximum height of the intersecting plates 6 is 15 mm; their maximum length is 20 mm and their maximum thickness in 3 mm.

The spikes 5*a*, 5*b* are disposed in a lattice having a mesh which is substantially square and of approximately 11.2 mm in size.

As can be seen from the drawing, the spikes 5*a* have one of their two intersecting plates 6 disposed parallel to the longitudinal axis 17 of the brush. On the other hand, the two intersecting plates of the plates 5*b* are at an angle of 45° with the axis 17 of the brush. In other words, the intersecting plates 5*a* are angularly offset by 45° with respect to the intersecting plates of the spikes 5*b*.

If the above-described massage brush is displaced parallel to its axis 17 on the skin, the action of the spikes 5*a* is made on the face of one of the two intersecting plates, whilst the action of the spikes 5*b* is made between the two intersecting plates within the dihedral angle which they form. The two intersecting plates of the spikes 5*b* are consequently acted upon laterally and therefore have a lower bending strength than the plates of the spikes 5*a* which have their faces acted upon. Thus, by displacing the massage brush parallel to its axis 17, the spikes 5*a* are, as a result of their angular orientation, less flexible than the spikes 5*b*. When in contact with the skin, the spikes 5*a* therefore appear to be "harder" and the spikes 3*b* "softer".

As a result of this, when rectilinear massage is carried out by displacing the brush 1 parallel or perpendicular to its axis 17, the region of the skin on which the brush is displaced is subjected to the action of a plurality of spikes 5*a*, 5*b* which are alternately slightly flexible and more flexible; as the spike alignments pass over the skin, they therefore create a slight depression on the skin, this depression having the shape of a corrugation or wave which, on the passage of the following alignment of spikes, is inverted as the spike 5*a* of an alignment is replaced in the following alignment by a spike 5*b* and vice versa. Consequently, this provides a very effective massage which causes hyperaemia in the area under treatment which facilitates the penetration of creams or lotions.

Figure 3:
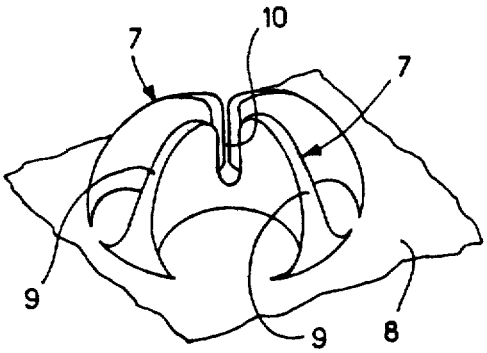
FIG. 3 is a similar view to that of FIG. 2, in which the two intersecting plates are in this case slit over a portion of their height at right angles to their intersection peak.
Figure 4:
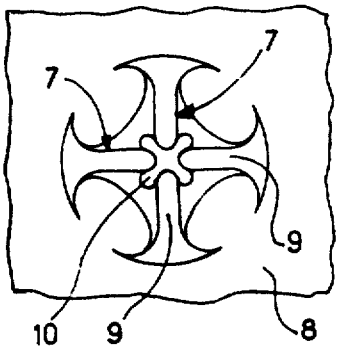
FIG. 4 is a top view of the two intersecting plates of FIG. 3.

FIGS. 3 and 4 show a variant of the construction of spikes having intersecting plates of the general type shown in FIGS. 1 and 2. The two intersecting plates 7 shown in FIGS. 3 and 4 are connected at right angles as in the case of the intersecting plates 6 shown in FIGS. 1 and 2, and they each have substantially the shape of the segment of a circle which is connected by its chord to a flexible support 8. The surrounding surface of the face 9 of the two intersecting plates 7 has substantially the shape of a hemi-sphere. In plan view (FIG. 4), the ends of the two intersecting plates 7 are widened out. In the same way the central portion of the two intersecting plates 7 is widened out in the direction of their zone of connection with the flexible support 8; the plates 7 are slit to approximately two-thirds of their height above their peak of intersection; the two slots 10 have, as can be seen from FIG. 4, the shape of an X.

The spikes constituted by the two intersecting plates 7 have substantially the same massage action as the spikes of the brush of FIGS. 1 and 2 except that the two slots 10 enable their flexibility to be increased.

Figure 6:
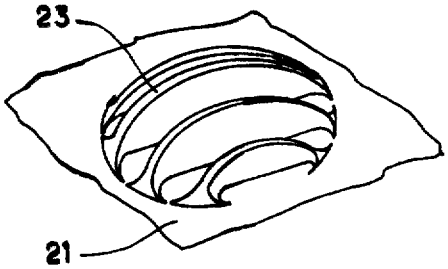
FIG. 6 is a perspective view, on an enlarged scale, of one of the spikes of the brush of FIG. 5.
Figure 5:
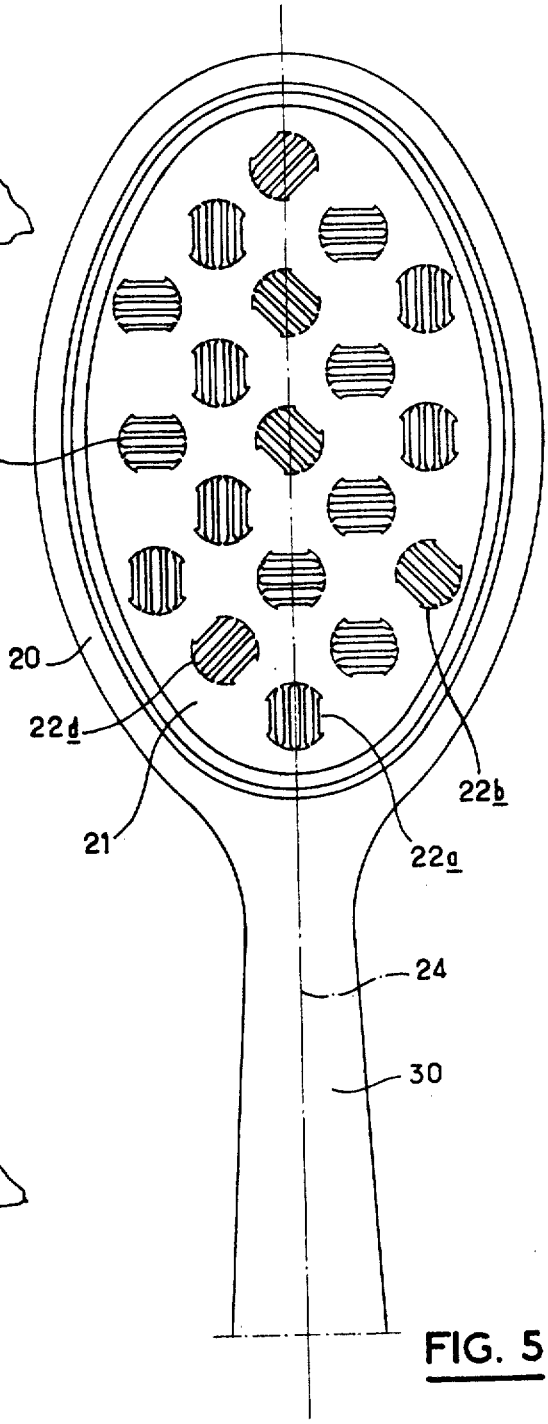
FIG. 5 is a plan view of a massage brush in accordance with a second embodiment of the invention.

FIGS. 5 and 6 of the drawings show a second embodiment of a massage brush according to the invention, which has a frame 20 integral with a handle 30. The frame 20 is provided with a substantially elliptical cavity within which there is mounted a flexible support 21. Four groups of spikes 22*a*, 22*b*, 22*c*, 22*d* are provided and project from the flexible support 21. The spikes 22*a*, 22*b*, 22*c*, 22*d* are integral with the flexible support 21 and are made from a rubbery material.

The spikes are disposed in a lattice having a square mesh on the flexible support 21. The spikes 22*a*, 22*b*, 22*c*, 22*d*, all have the same shape, and only their relative angular orientation is different. The spikes 22*a*, 22*b*, 22*c*, 22*d* each comprise four substantially parallel plates 23 connected at right angles to the flexible support 21. Each plate has the shape of the segment of a circle which is connected by its chord to the flexible support 21. The surrounding surface of the face of the four plates 23 of a spike has the shape of a spherical portion. The plates 23 have, in the vicinity of their ends, a slightly increased thickness.

As can be seen from FIG. 5, the plates of the spikes 22*a* are parallel to the longitudinal axis 24 of the brush, while the plates of the other spikes 22b, 22c and 22d are oriented as shown. The plates 23 of the spikes of a same group 22a, 22b, 22c, 22d are orientated at 45° or a multiple thereof with respect to the plates 23 of the spikes of another group. The spikes of a same group alternate with spikes of the other groups on the flexible support 21.

If the massage brush shown in FIGS. 5 and 6 is displaced parallel to its axis 24 on the skin, the action of the spikes 22a is made on the face of the plates 23, whilst the action of the spikes 22c is made perpendicularly on the sides of the plates 23. The action of the spikes 22b and 22d also takes place laterally but with an angle of incidence of 45°. The plates 23 of the spikes 22b, 22c, 22d are consequently acted upon laterally and therefore have a lower bending strength than the plates of the spikes 22a which are acted upon by their face. Thus, by displacing the massage brush parallel to its axis 24, the skin comes into contact with the spikes 22a which appear "harder" than the spikes 22b, 22d which are themselves slightly harder than the spikes 22c.

The massage action produced by the brush of this second embodiment is similar to that obtained with the brush of FIGS. 1 and 2.

It should also be noted that the brushes of the two embodiments, as a result of the flexible material from which the spikes 5a, 5b, 22a, 22b, 22c, 22d are made and as a result of the rounded shape of the intersecting plates or non-intersecting plates which constitute them, are unable to cause either abrasion or destruction by friction of the epidermal layers, even if energetic massaging is carried out.

It should be understood that the embodiments described above are in no way limiting and may include any desirable modifications without departing from the scope of the invention.

I claim:

1. A massage instrument for the skin, comprising:

(a) at least one active face (a); there being provided on each said active face (a)

(b) an array of a plurality of groups of projecting spikes (b) each of which is made of an elastically-deformable, flexible material; with each of said spikes (b) being made up of (c) at least two intersecting plates displaced so as to uprightly-extend from each of said active faces (a) on which said spike groups (b) are provided, with said intersecting plates having a relative angular orientation one between another so that, when viewed in plan perspective, they provide X-like projections, with each of said respective spike groups (b) provided on each said active face (a) being disposed relative to one another in relative spaced alignment and in a randomly alternating aligned arrangement one relative to the next, with alternate spikes in each of said respective spike groups (b) having differing orientation angulations in their given intersecting plates (c), so that the spikes of each same sort of group in said spike groups array (b) are disposed in said randomly alternating arrangement on each active face (a) on which they are provided with the spikes of each of another of the same group.

2. The instrument according to claim 1, wherein the spikes in said spike groups (b) are constructed integral with a support therefor.

3. The instrument according to claim 1, wherein the plates constituting the spikes in said spike groups (b) are disposed substantially at right angles on a support therefor and have the shape of the segment of a circle connected by its chord to the support.

4. The instrument according to claim 1, wherein the surrounding surface of the face of the plates of each spike in said spike groups (b) has substantially the shape of a spherical portion.

5. The instrument according to claim 1, wherein each of the spikes in said spike groups (b) consists of two intersecting plates which have, in plan view, the shape of an X, the angular orientation of the intersecting plates of the spikes belonging to one group relative to the angular orientation of the intersecting plates of the spikes belonging to another group being determined by rotation about an axis passing through the intersection peak of the two intersecting plates of the spikes.

6. The instrument according to claim 5, wherein each of the spikes in said spike groups (b) is symmetrical about an axis passing through the intersection peak of the two intersecting plates which constitute it.

7. The instrument according to claim 5, wherein the two intersecting plates of each spike in said spike groups (b) are disposed substantially at right angles to each other and wherein the spikes of a same group are orientated at 45° with respect to the spikes of another same group.

8. The instrument according to claim 5, wherein the intersecting plates of the spikes in said spike groups (b) are cut over a portion of their height at right angles to their intersection peak.

9. The instrument according to claim 1, which constitutes a massage brush, a support of the spikes in said spike groups (b) being disposed within a rigid frame.

10. An instrument that is in accordance with any one of the instruments pursuant to claims 1, 2–8 or 9, inclusive, wherein both said spikes in said spike groups (b) and the face (a) on which said spikes are provided on the support for the said spikes are constituted of a rubbery material of construction.

* * * * *